US005629130A

United States Patent [19]

Leenders et al.

[11] Patent Number: 5,629,130

[45] Date of Patent: May 13, 1997

[54] METHOD FOR THE FORMATION OF A HEAT MODE IMAGE

[75] Inventors: Luc Leenders, Herentals; Rita Torfs, Herenthout, both of Belgium

[73] Assignee: Agfa-Gevaert N.V., Mortsel, Belgium

[21] Appl. No.: 667,972

[22] Filed: Jun. 19, 1996

[30] Foreign Application Priority Data

Jun. 30, 1995 [EP] European Pat. Off. ..... 95201741

[51] Int. Cl.[6] ..... G03C 8/10; G03C 8/08

[52] U.S. Cl. ..... 430/201; 430/200; 430/964; 430/950

[58] Field of Search ..... 430/200, 201, 430/964; 503/227

[56] References Cited

U.S. PATENT DOCUMENTS

| | | | |
|---|---|---|---|
| 4,772,582 | 9/1988 | DeBoer | 430/201 |
| 5,240,900 | 8/1993 | Burberry | 430/200 |
| 5,254,524 | 10/1993 | Guittard et al. | 430/200 |
| 5,334,575 | 8/1994 | Noonan et al. | 430/200 |
| 5,547,809 | 8/1996 | Defieuw et al. | 430/200 |

*Primary Examiner*—Richard L. Schilling

*Attorney, Agent, or Firm*—Brumbaugh, Graves, Donohue & Raymond

[57] ABSTRACT

A new method is disclosed for the formation of a heat mode image comprising exposing to a heat pattern a donor element comprising a reactant (A) while in contact with an acceptor element comprising a reactant (B), the said reactant (A) being transferred by said exposure from said donor element to said acceptor element to form an image therein by reaction of said reactant (A) with said reactant (B), (2) separating said donor and said acceptor element from each other, and (3) optionally giving said acceptor element a post-treatment consisting of a supply of extra energy, characterized in that the said acceptor element comprises spacing particles also containing a said reactant (B), and/or the said donor element comprises spacing particles also containing a said reactant (A), or a said reactant (B), or a density providing compound, preferably carbon black, or combinations thereof.

In the preferred embodiment reactant (A) is a reducing agent and reactant (B) is an organic silver salt, preferably silver behenate. In this case a heat post-treatment on the separated acceptor is performed.

The heat pattern is preferably generated by laser exposure.

14 Claims, No Drawings

METHOD FOR THE FORMATION OF A HEAT MODE IMAGE

1. FIELD OF THE INVENTION

The present invention relates to a method for the formation of an image with improved physical characteristics using an information-wise distributed heat pattern.

2. BACKGROUND OF THE INVENTION

Conventional photographic materials based on silver halide are used for a large variety of applications. For instance, in the prepress sector of graphic arts rather sensitive camera materials are used for obtaining screened images. Scan films are used for producing colour separations from multicolour originals. Phototype setting materials record the information fed to phototype and image setters. Relative insensitive photographic materials serve as duplicating materials usually in a contact exposure process. Other fields include materials for medical recording, duplicating and hard copy, X-ray materials for non-destructive testing, black-and-white and colour materials for amateur and professional still photography and materials for cinematographic recording and printing.

Silver halide materials have the advantage of high potential intrinsic sensitivity and excellent image quality. On the other hand they show the drawback of requiring several wet processing steps employing chemical ingredients which are suspect from an ecological point of view. As a consequence it is undesirable that depleted processing solutions would be discharged into the public sewerage; they have to be collected and destroyed by combustion, a cumbersome and expensive process.

In the past several proposals have been made for obtaining an image that can be formed using only dry development steps without the need of processing liquids as it is the case with silver halide photographic materials.

As a particular alternative for conventional silver halide chemistry dry imaging elements are known that can be image-wise exposed using an image-wise distribution of heat. When this heat pattern is indirectly generated by the conversion of radiation, e.g. laser radiation, into heat these types of dry imaging elements are called heat mode materials. When the heat pattern is provided directly, e.g. by means of a thermal head, these elements are called thermal recording materials or thermographic materials. Both types of elements offer the advantage in addition to an ecological advantage that they do not need to be handled in a dark room nor any other protection from ambient light is needed. Heat mode recording materials, based on change of adhesion, are disclosed in e.g. U.S. Pat. Nos. 4,123,309, 4,123,578, 4,157,412, 4,547,456 and PCT applications WO 88/04237 and WO 93/03928.

In still another type of heat mode recording materials information is recorded by creating differences in reflection and/or transmission in the recording layer. The recording layer has high optical density. The conversion of radiation into heat brings about a local temperature rise, causing a change such as evaporation or ablation to take place in the recording layer. As a result, the irradiated parts of the recording layer are totally or partially removed, and a difference in optical density is formed between the irradiated parts and the unirradiated parts (cf. U.S. Pat. Nos. 4,216,501, 4,233,626, 4,188,214 and 4,291,119 and British Pat. No. 2,026,346). In a preferred embodiment the recording layer of such heat mode recording materials is made of a metal, e.g. bismuth.

Still another type of non-conventional materials as alternative for silver halide is based on photopolymerisation. The use of photopolymerizable compositions for the production of images by information-wise exposure thereof to actinic radiation is known since quite a while. All these methods are based on the principle of introducing a differentiation in properties between the exposed and non-exposed parts of the photopolymerizable composition e.g. a difference in solubility, adhesion, conductivity, refractive index, tackiness, permeability, diffusibility of incorporated substances e.g. dyes etc. The thus produced differences may be subsequently employed in a dry treatment step to produce a visible image and/or master for printing e.g. a lithographic or electrostatic printing master.

Another dry imaging system working according to photo mode and known since quite a while is 3M's Dry Silver technology. It is a catalytic process which couples the light-capturing capability of silver halide to the image-forming capability of organic silver salts.

An image forming system which is chemically very similar to Dry Silver but works according to heat mode since a photosensitive silver, halide is absent is disclosed in European patent application Appl. No. 94200794, filed 24 Mar. 1994. Here a method is disclosed for the formation of a heat mode image comprising the steps of:

(1) preparing a donor element by coating on a support one or more donor layers containing, distributed over said one or more layers, a reducing agent, a radiation to heat converting compound, and optionally a polymeric binder;

(2) preparing an acceptor element by coating on a support an acceptor layer containing a reducible organic silver salt and a polymeric binder;

(3) bringing said donor layer and said acceptor layer in close contact with each other;

(4) information-wise exposing the contacting elements with laser radiation, thus inducing the partial or complete transfer of said donor layer(s) to the acceptor element and/or diffusion of said reducing agent into the acceptor element;

(5) peeling apart the donor and acceptor elements

Preferably the separated acceptor element is subjected to an overall heat treatment.

In an alternative embodiment the acceptor element contains the radiation to heat converting compound.

Such systems are based on a direct chemical reduction of an organic silver salt, e.g. silver behenate, under the influence of heat. However, due to the pressing together of acceptor and donor, which is normally done under vacuum, an unreproducible inhomogeneous close contact is established between the donor and the acceptor. As a result, after the separation step so-called contact spots tend to appear in the final image due to an irreproducible transfer of donor material. These contact spots give the final image an uneven outlook which is commercially unacceptable. When trying to prevent this defect by incorporating a conventional matting or spacing agent on the surface of donor and/or binder element thus establishing a reproducible more loose contact, as is disclosed in U.S. Pat. Nos. 772,582 and 4,876,235, the obtained density is to low since the chemical reduction is hampered in those local points were spacing particles are present giving rise to a high number of so-called pinholes. The appearance of problems with contact spots and pinholes is not limited to the case where the reacting pair is an organic silver salt and a reducing agent. They will also be present in the case of any pair of a reactant (A) and a reactant (B) that are capable of forming some kind of density by chemical or photochemical reaction with each other.

It is an object of the present invention to provide a method for the formation of a heat mode image which is substantially free of the contact spot defect while providing a sufficiently high density.

It is a further object of the present invention to provide an imaging method, that can serve as an alternative for conventional image-setting based on silver halide films, and that provides an image which can be used for direct visual inspection, e.g. a radiographic image for medical purposes, or as master for the exposure of a printing plate or proofing material.

3. SUMMARY OF THE INVENTION

The objects of the present invention are realized by providing a method for the formation of a heat mode image comprising the steps of (1) exposing to an information-wise distributed heat pattern a donor element comprising a support and at least one layer comprising a reactant (A) while in contact with an acceptor element comprising a support and at least one layer comprising a reactant (B), the said reactant (A) being transferred by said exposure from said donor element to said acceptor element to form an image therein by reaction of said reactant (A) with said reactant (B), (2) separating said donor and said acceptor element from each other, and (3) optionally giving said acceptor element a post-treatment consisting of an extra supply of energy, characterized in that the said acceptor element comprises spacing particles also containing a said reactant (B), and/or the said donor element comprises spacing particles also containing a said reactant (A), or a said reactant (B), or a density providing compound, or combinations thereof.

In the preferred embodiment reactant (A) present in the donor element is a reducing agent, and reactant (B) present in the acceptor element is a reducible organic silver salt, most preferably silver behenate. The information-wise distributed heat pattern can be applied by means of a thermal head, as is disclosed e.g. in European patent applications appl. Nos. 94200612, 94202980, and International application publ. No. WO 94/11198, or, more preferably by conversion of laser radiation into heat. In this preferred embodiment a heat post-treatment is provided.

4. DETAILED DESCRIPTION OF THE INVENTION

The present invention will now be explained in detail on the hand of its preferred embodiment. First of all the essential ingredients of the donor and acceptor elements will be discussed.

Both elements contain a support and at least one of both supports must be transparent in case of the preferred embodiment of exposure by laser. In the case of use of a thermal head the supports do not need to be transparent. Suitable transparent supports include e.g. cellulose nitrate film, cellulose acetate film. poly(vinyl acetal) film. polystyrene film, poly(ethylene terephthalate) film, polycarbonate film, polyvinylchloride film or poly-α-olefin films such as polyethylene or polypropylene film. The thickness of such organic resin film is preferably comprised between 0.025 and 0.20 mm. Suitable opaque supports include paper, e.g. resin coated paper.

In a most preferred embodiment the support is a polyethylene terephthalate support, preferably provided with a subbing layer. An example of a suitable subbing layer is a layer containing a polymer containing covalently bound chlorine. Suitable chlorine containing polymers are e.g. polyvinyl chloride, polyvinylidene chloride, a copolymer of vinylidene chloride, an acrylic ester and itaconic acid, a copolymer of vinyl chloride and vinylidene chloride, a copolymer of vinyl chloride and vinyl acetate, a copolymer of butylacrylate, vinyl acetate and vinyl chloride or vinylidene chloride, a copolymer of vinyl chloride, vinylidene chloride and itaconic acid, a copolymer of vinyl chloride, vinyl acetate and vinyl alcohol, chlorinated polyethylene, polychloroprene and copolymers therof, chlorosulfonated polyethylene, polychlorotrifluoroethylene, polymethyl-alpha-chloroacrylate etc. A preferred chlorine containing polymer is co(vinylidenechloride-methylacrylate-itaconic acid; 88% /10% /2%).

Suitable polymers not containing chlorine include co(styrene-butadiene-carbonic acid), polyvinyl acetate, and co(methylmethacrylate-butadiene-itaconic acid). In the latter case the amount of the itaconic acid part is preferably comprised between 2 and 15%. The $T_g$ of the polymer can be adjusted by varying the relative amounts of the methylmethacrylate and the butadiene parts while keeping the itaconic acid part constant at about 5%. In a most preferred embodiment the copolymer is composed of 47.5% of methylmethacrylate, 47.5% of butadiene and 5% of itaconic acid.

Essentially the donor element contains a reducing agent, optionally a binder and, in the case of laser exposure, a radiation to heat converting compound. In a preferred embodiment the radiation to heat converting compound and the reducing agent are simply contained in just one layer. Alternatively they can be distributed over a layer pack, preferably a double layer pack, one layer containing the radiation to heat converting compound, the other containing the reducing agent. In the latter case the radiation to heat converting compound is preferably incorporated in a layer adjacent to the layer containing this reducing agent.

Suitable reducing agents for use in the heat mode element include pyrogallol, 4-azeloyl-bis-pyrogallol, 4-stearyl pyrogallol, galloacetophenone, di-tertiary-butyl pyrogallol, gallic acid anitide, methyl gallate, sodium gallate, ethyl gallate, normal- and iso-propyl gallate, butyl gallate, dodecyl gallate, gallic acid, ammonium gallate, ethyl protocatechuate, cetyl protocatechuate, 1-hydroxy-2-naphthoic acid, 2-hydroxy-3-naphthoic acid, phloroglucinol, catechol, 2,3-naphthalene diol, 4-lauroyl catechol, protocatechualdehyde, 4-methyl esculetin, 3,4-dihydroxy benzoic acid and its esters, 2,3-dihydroxy benzoic acid and its esters, 2,5-dihydroxy-benzoic acid and its esters, hydroquinone, t.-butylhydroquinone, isopropylhydroquinone, 2-tetrazolylthiohydroquinonens, e.g., 2methyl-5-(1-phenyl-5-tetrazolylthio)hydroquinone, 5-pyrazolones, 3-pyrazolones, 4,4'-dihydroxy-biphenyl, bis(2-hydroxy-3-t.-butyl-5-methylphenyl)methane, 2,2-bis(4-hydroxy-3-methylphenyl)propane, 4,4-ethylidene-bis(2-t.-butyl-6-methylphenol), 2,2-bis(3,5-dimethyl-4-hydroxyphenyl)propane, ascorbic acid and its derivatives, 3,4-dihydroxyphenylacetic acid, 4-(3',4'-dihydroxyphenylazo)benzoic acid, 2,2'-methylene-bis-3,4,5-trihydroxybenzoic acid, ortho-, meta- and para-phenylenediamine, tetramethyl benzidine, 4,4',4"-diethylamino-triphenylmethane, o-, m-, and p-aminobenzoic acid, 4-methoxy-l-hydroxy-dihydronaphthalene and tetrahydroquinoline. Further useful reducing agents comprise aminocycloalkenone compounds, esters of amino reductones, N-hydroxyurea derivatives, hydrazones of aldehyde and ketones, phosphoramidophenols, phosphor amidoanilines, (2,5-dihydroxyphenyl)sulphone, tetrahydroquinoxalines, 1,2,3,4-tetrahydroquinoxaline, amidoximes, azines, hydroxamic acids, sulphonamidophenols, 2-phenylindane-1,3-dione, 1-4-dihydropyridines, such as 2,6-dimethoxy-3,5-dicarbethoxy-1,4-dihydropyridine. Still other useful reducing agents include resorcins, m-aminophenols, α-and β-naphtols, alkylphenols and alkoxynaphtols. A further class of reducing agents is constituted by hydrazine compounds. Especially preferred-hydrazine compounds include p-tolylhydrazine hydrochloride, N,N-phenylformylhydrazide, acetohydrazide, benzoylhydrazide, p-toluenesulphonylhydrazide. N,N'-diacetylhydrazine, β-acetyl-phenylhydrazine, etc.

Another possible reducing agent is "Spirana", a spiro-bis-indane derivative, disclosed in European patent application Appl. No. 93203120, corresponding to following chemical formula:

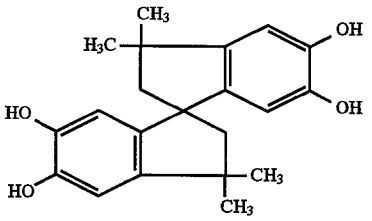

Most preferred reducing agents for the practice of this invention are dodecyl gallate, ethyl gallate, phenylpyrocatechol, propyl gallate or combinations thereof.

The acceptor layer and optionally the donor layer(s) contain a binder. Suitable binders include cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from (meth)acrylates and (meth)acrylate derivatives, such as polyacrylic acid, polymethyl methacrylate and styrene-acrytate copolymers; polyester resins; polycarbonates; copoly(styrene-acrylonitrile); polysulfones; polyphenylene oxide; organosilicones such as polysiloxanes; epoxy resins and natural resins, such as gum arabic. When using copoly (stryrene-acrylonitrile) the copolymer preferably comprises at least 65% by weight of styrene units and at least 25% by weight of acrylonitrile units, but other comonomers can be present, e.g., butadiene, butyl acrylate and methyl methacrylate.

In case of the preferred way of recording, i.e. by laser exposure, the radiation to heat converting substance preferably present in the donor transforms the information-wise modulated laser exposure into an information-wise modulated pattern of heat. In a most preferred embodiment the laser is an infra-red laser and the radiation to heat converting substance is an infra-red absorbing compound. This infra-red absorbing compound can be a soluble infra-red absorbing dye or a dispersable infra-red absorbing pigment. Infra-red absorbing compounds are known since a long time and belong to several different chemical classes, e.g. indoaniline dyes, oxonol dyes, porphine derivatives, anthraquinone dyes, merostyryl dyes, pyrylium compounds and sqarylium derivatives.

The information-wise exposure can be performed through the support of the donor or through the support of the acceptor, the former case being the most preferred.

A suitable infra-red dye can be chosen from the numerous disclosures and patent applications in the field, e.g., from U.S. Pat. Nos. 4,886,733, 5,075,205, 5,077,186, 5,153,112, 5,244,771, from Japanese unexamined patent publications (Kokai) No.'s 01-253734, 01-253735, 01-253736, 01-293343, 01-234844, 02-3037, 02-4244, 02-127638, 01-227148, 02-165133, 02-110451, 02-234157, 02-223944, 02-108040, 02-259753, 02-187751, 02-68544, 02-167538, 02-201351, 02-201352, 03-23441, 03-10240, 03-10239, 03-13937, 03-96942, 03-217837, 03-135553, 03-235940, and from the European published patent application No.'s 0 483 740, 0 502 508, 0 523 465, 0 539 786, 0 539 978 and 0 568 022. This list is far from exhaustive and limited to rather recent disclosures.

In a preferred embodiment the infra-red dye is chosen from German patent application DE 43 31 162.

Another preferred infra-red absorber is represented by formula IRD-1 (see furtheron). This is a commercial product known as CYASORB IR165, marketed by American Cyanamid Co, Glendale Protective Technologie Division, Woodbury, N.Y. It is a mixture of two parts of the molecular non-ionic form (IRD-1a) and three parts of the ionic form (IRD-1b) represented by:

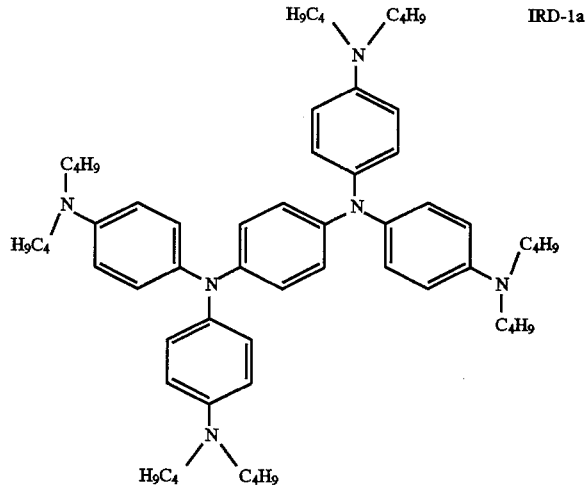

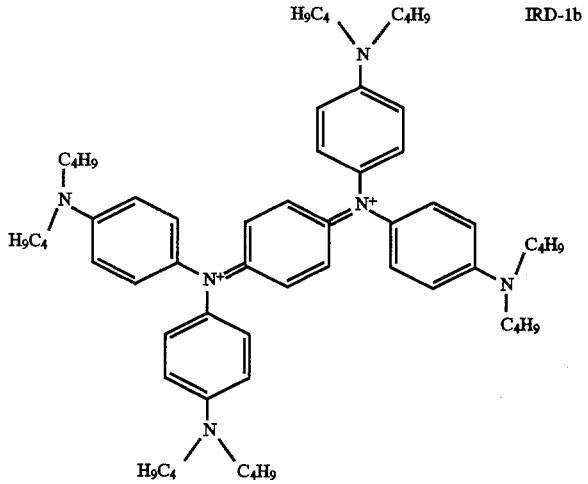

The concentration of the infra-red absorbing dye is preferably comprised between 0.05 and 3 mmole/$m^2$. The optimal concentration is dependent self-evidently on its extinction coefficient at the laser emission wavelength.

Apart from infra-red dyes, dispersable infra-red absorbing pigments can be used. This pigments can be coloured, e.g. phtalocyanine pigments. However the most preferred pigment is carbon black. absorbing in the infra-red and the visible spectral region. It can be used in the amorphous or in the graphite form. The preferred average particle size of the carbon black ranges from 0.01 to 1 μm. Different commercial types of carbon black can be used, preferably with a very fine average particle size, e.g., RAVEN 5000 ULTRA II (Columbian Carbon Co.), CORAX L6, FARBRUSS FW 200, SPEZIALSCHWARZ 5, SPEZIALSCHWARZ 4A, SPEZIALSCHWARZ 250 and PRINTEX U (all from Degussa Co.).

The total coverage of the donor layer(s) is preferably comprised between 0.5 and 10 $g/m^2$.

The donor layer can further contain surfactants.

The most important ingredient of the acceptor layer of the acceptor element is the reducible organic silver salt. Substantially light-insensitive organic silver salts particularly suited for use according to the present invention in the heat-sensitive recording layer are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate. Silver salts of modified aliphatic carboxylic acids with thioether group as described e.g. in GB-P 1,111,492 and other organic silver salts as described in GB-P 1,439,478, e.g. silver benzoate and silver phthalazinone, may be used likewise. Further can be used silver salts of aromatic carboxylic acids (e.g. benzoic acid, phtalic acid, terephtalic acid, salicylic acid, m-nitrobenzoic-, phenylacetic-, pyromellitic-, p-phenylbenzoic-, camphoric-, huroic-, acetamidobenzoic- and o-aminobenzoic acid, etc.). Furtheron can be used silver salts of mercapto group- or thione group-containing compounds (e.g., 3-mercapto-4-phenyl-1,2,4-triazole, 2-mercaptobenzimidazole, etc.) or an imino group-containing compound (e.g. benzotriazole or derivatives thereof as described in GB 1,173,426 and U.S. Pat. No. 3,635,719, etc.). Further can be mentioned silver imidazolates and the substantially light-insensitive organic silver salt complexes described in U.S. Pat. No. 260,677.

In a most preferred embodiment of the present invention the organic silver salt is silver behenate. The compound is colourless. visibly stable toward light, insoluble in many volatile liquid vehicles, and moisture-resistant. It is produced in the desired physical form without difficulty and at reasonable cost.

The acceptor layer preferably further contains a tone modifier in order to obtain a neutral density. Suitable toning agents are the phthalimides and phthalazinones within the scope of the general formulae described in U.S. Pat. No. Re. 30,107. Further reference is made to the toning agents described in U.S. Pat. No. 's 3,074,809, 3,446,648 and 3,844,797. Other particularly useful toning agents are the heterocyclic toner compounds of the benzoxazine dione or naphthoxazine dione type within the scope of following general formula:

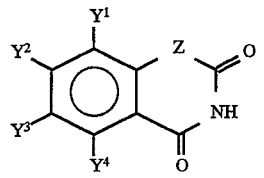

wherein

Z represents O or N-alkyl;

each of $Y^1$. $Y^2$. $Y^3$ and $Y^4$ (same or different) represents hydrogen, alkyl, e.g. $C_1$–$C_{20}$ alkyl, preferably $C_1$–$C_4$ alkyl, cycloalkyl, e.g. cyclopentyl or cyclohexyl, alkoxy, preferably methoxy or ethoxy, alkylthio with preferably up to 2 carbon atoms, hydroxy. dialkylamino of which the alkyl groups,have preferably up to 2 carbon atoms or halogen, preferably chlorine or bromine; or $Y^1$ and $Y^2$ or $Y^2$ and $Y^3$ represent the ring members required to complete a fused aromatic ring, preferably a benzene ring, or $Y^3$ and $Y^4$ represent the ring members required to complete a fused-on aromatic or cyclohexane ring. Toners within the scope of said general formula are described in GB-P 1,439,478 and U.S. Pat. No. 3,951,660.

A toner compound particularly suited is 3.4-dihydro-2,4-dioxo-1,3,2H-benzoxazine described in U.S. Pat. No. 3,951,660.

The acceptor layer can further contain the same types of binders and other ingredients, such as surfactants, as the donor layer As stated above the gist of the present invention is a solution to the problem of hampered local density formation when a conventional spacing agent is used. This is performed by the use of a particular type of reactive spacing agent the composition and preparation of which will be now explained in detail. This spacing agent essentially comprises a polymeric resin binder and a functional compound chosen from a reducing agent, a reducible organic silver salt and a density providing compound.

The spacing particles can essentially be of any nature as well with respect to the composition of its polymeric resin part, shape, size, and preparation method and the sign of their tribo-electrically acquired charge.

The spacing particles used in accordance with the present invention may comprise any conventional resin binder. The binder resins used for producing spacing particles may be addition polymers e.g. polystyrene or homologues, styrene/acrylic copolymers, styrene/methacrylate copolymers, styrene/acrylate/acrylonitile copolymers or mixtures thereof. Addition polymers suitable for the use as a binder resin in the production of spacing particles are disclosed e.g. in BE 61.855/70, DE 2,352,604, DE 2,506,086, U.S. Pat. No. 3,740,334.

Also polycondensation polymers may be used in the production of spacing particles used in accordance with the present invention. Polyesters prepared by reacting organic carboxylic acids (di- or tricarboxylic acids) with polyols (di- or triol) are the most prefered polycondensation polymers. The carboxylic acid may be e.g. maleic acid, fumaric acid, phthalic acid, isophthalic acid, terephthalic acid, trimellitic acid, etc or mixtures thereof. The polyolcomponent may be ethylene glycol, diethylene glycol, polyethylene glycol, a bisphenol such as 2,2-bis(4-hydroxyphenyl)propane called "bisphenol A" or an alkoxylated bisphenol, a trihydroxy alcohol, etc., or mixtures thereof. Polyesters suitable for use in the preparation of spacing particles are disclosed in e.g.

U.S. Pat. Nos. 3,590,000, 3,681,106, 4,525,445, 4,657,837, 5,153,301. It is also possible to use a blend of addition polymers and polycondensation polymers in the preparation of spacing particles as disclosed e.g. in U.S. Pat. No. 4,271,249.

The amount of reducing agent, organic silver salt or density providing compound incorporated in the spacing particles is preferably comprised between 5 and 50% by weight.

The particular spacing particles for use in accordance with the present invention can be incorporated in the donor element or in the acceptor element. When the spacing agent is incorporated in the donor element it can contain, apart from its basic polymeric resin, a reducing agent, an organic silver salt or a density providing compound, preferably carbon black. When the spacing agent is incorporated in the acceptor element it makes only sense to incorporate an organic silver salt in the spacing agent. By each of these four embodiments the objects of the present invention can be realized. Thanks to the reaction of reducing agent and organic silver salt in the spacing agent, or to the reaction of organic silver salt with reducing agent in the spacing particles, or to the mere presence of the carbon in the spacing agent density is built up also in those areas where spacing particles are located. Even in the case wherein this density is considerably lower than the main density of those areas where spacing particles are absent the visual appearance of pinholes will be absent.

In principle, the reducing agent in the spacing particle can be different from the one in the donor, and the organic silver salt in the spacing particle can be different from the one in the acceptor, but, most simply and preferably, the same compounds are used inside and outside the spacing agent.

Also in principle one and the same spacing agent can comprise mixtures of a reducing agent and a density providing compound, or of an organic silver salt and a density providing compound.

The particular spacing particles used in connection with the present invention can be incorporated in the donor or acceptor layer itself, or they can be incorporated in a separate layer closer to the support, or they can be incorporated in a separate layer on top of the donor or acceptor element. It will be readily understood that, in order to exert their spacing function properly, the particles must protrude to a certain degree from the surface of the donor or acceptor, or must induce a relief in the layer package wherein they are incorporated; in other words the spacing particles must be sufficiently large. It will also be clear that the minimal average diameter of the particles will be larger when they are incorporated in the donor or acceptor layer or in a subcoat than when they are incorporated in an extra top layer.

Before exposure the donor element and the acceptor element must be brought in close contact with each other. This can be done by different procedures. e.g., (a) the elements can simply be pressed together by vacuum suction, (b) the elements can be laminated to each other optionally by the application of heat, or (c) either the acceptor or the donor can be provided with a thin adhesive layer on top of it so that they can be pressed together in a laminator without the need for vacuum suction.

After the donor and acceptor are brought in close contact this assemblage is, in the preferred embodiment of the present invention, information-wise exposed by means of an intense laser beam. Such a laser can be an Ar ion laser, a HeNe laser, a Kr laser, a frequency doubled Nd-YAG laser, a dye laser emitting in the visual spectral region. However in the preferred. embodiment where the radiation to heat converting compound is an infra-red absorbing compound the laser is an infra-red laser. Especially preferred lasers are semiconductor diode lasers or solid state lasers such as a Nd-YAG laser emitting at 1064 nm, or a Nd-YLF laser emitting at 1053 nm. Other possible infra-red laser types include diode lasers emitting at 780 nm or diode lasers emitting at 830 nm. Any emission wavelength is suitable provided the absorption maximum of the infra-red absorbing compound matches this emission wavelength. A series of lasers can be used arranged in a particular array. Important parameters of the laser recording are the spot diameter (D) measured at the $1/e^2$ value of the intensity, the applied laser power on the film (P), the recording speed of the laser beam (v) and the number of dots per inch (dpi).

In an alternative embodiment the heat pattern is generated by a thermal printing head.

As a consequence of the transformation of radiation into heat at the exposed areas, or of the direct supply of heat by the thermal head, and depending on the particular composition of the elements, the donor layer(s) is (are) partially or completely transferred to the acceptor and remain(s) part of the acceptor after separation of the elements. By varying the intensity of and/or the time of laser irradiation the produced amount of heat can be modulated and in this way the amount of reducing agent (or other reactive ingredient) transferred. In this way a series of intermediate grey levels can be obtained. A similar mechanism will appear when the reacting pair is composed of other ingredients than an organic silver salt and a reducing agent.

The peeling apart of the elements can be performed by hand or by mechanical means.

Since at this stage the thermal reduction of the organic silver salt is far from complete an overall heat treatment of the separated acceptor element is needed for obtaining a sufficient optical density. An optimal overall heating lasts at least 2 s, preferably about 5 s at about 118 ° C. At lower temperatures the heating time is longer and vice versa.

The obtained heat mode image can be used as an intermediate for the UV-exposure of a UV-sensitive element, e.g., a printing plate or a silver halide contact material or a proofing material. In both cases tie heat mode image forms an alternative for a conventional developed silver halide image-setting film. On the other hand the obtained heat mode image can be meant for direct visual inspection. e.g., in case of proofing purposes or in case of recording of radiographic medical information.

The present invention has been explained in detail by means of its preferred embodiment wherein reactant (A) is a reducing agent and reactant (B) is a reducible organic silver salt. However. it will be clear to anyone skilled in the art that the same inventive concept can be applied to other chemical types of reactant pairs (A) and (B), as long as some kind of density is built up by the reaction between (A) and (B). According to the nature of reactants (A) and (B) the nature of the post-treatment, giving an additional supply of energy, can be different, e.g. a heat post-treatment, an overall radiation post-treatment, like a UV post-treatment, or no post-treatment at all. An example of an alternative reactive pair is constituted by a leucodye and an acid capable of converting this leucodye into a dye. In this way a coloured image can be obtained. In a preferred embodiment the leucodye is present in the donor, the acid in the acceptor. and the acid is also incorporated in a spacing agent which is applied on top of the acceptor element. Density is formed usually without the need of a heat post-treatment.

Preferred types of leucodyes are leucotriarylmethane derivatives, azo compounds and spiropyranes. Preferred types of acids are salicylic acid and benzyl-p.-hydroxybenzoic acid.

Still other examples of reactive pairs are summarized in following table:

| reactive pair | end product | post-treatment |
|---|---|---|
| iron(III)stearate + pyrogallic acid | dye | ΔT |
| dithioxamide deriv. + metal salts | " | " |
| iron(III)stearate + methyl gallate | " | " |
| heterocyclic hydrazine deriv. + iron salts | " | " |
| 2-aminothiazoles + oxidantia of type N—Cl (??) | " | " |
| triazenes + aromatic azo couplers (e.g. naphtols) | " | " |
| leucomalachitegreen + bisimidazole | malachite-green | UV |
| leuco compounds of the triphenylmethane type + bisimidazole | dye | " |
| $CBr_4$ + diphenylamine | triphen. meth.-dye | " |
| $CBr_4$ + indole | dye | " |
| spiropyrane + $CBr_4$ | pyrylium dye | " |
| 4-(p-dimethyl-amino-styryl)quinoline + $CBr_4$ | dye | " |
| aldehydes + o-dianisidine | colour | none or ΔT |
| copper salts + bezoinoxime | colour | ΔT |
| chromates + $AgNO_3$ | red $Ag_2CrO_4$ | " |
| diazonium salt + colour coupler + morpholine | colour | none |

The following examples illustrate the present invention without however limiting it thereto.

EXAMPLES

Example 1

In this example reactive spacing particles containing silver behenate were present in the acceptor element.

preparation of reactive spacing particles containing silver behenate

A series of samples of reactive spacing particles varying in ratio of amount resin/amount silver behenate and in average diameter (see table 1) was prepared as follows.

Predetermined amounts of commercial resin ATLAC T500 (Atlas Chem. Ind.) corresponding to copoly (propyleneglycol-bisphenol A-fumaric acid) on the one hand and silver behenate on the other hand were mixed intimately by shaking in a plastic bag. Then this mixture was placed in a melt kneader and heated to 103 ° C. to form a melt. This melt was kneaded for 15 minutes. Thereafter the mixture was allowed to cool down to room temperature and the mass was crushed to give particles showing a homogeneous distribution of resin and silver behenate. By sieving the obtained particles through sieves with varying diameters different particle distributions were obtained. The bead characteristics are represented in table 1.

TABLE 1

| sample No. | ratio resin/silver behenate | Dv* | Dn* |
|---|---|---|---|
| (1) | — | — | — |
| 2 | 89/11 | 4.66 | 3.34 |
| 3 | " | 9.04 | 4.42 |
| 4 | " | 9.32 | 6.83 |
| 5 | " | 15.66 | 12.4 |
| 6 | 85/15 | 5.73 | 3.63 |
| 7 | " | 9.45 | 4.47 |
| 8 | " | 9.86 | 7.54 |
| 9 | " | 14.42 | 12.1 |

*dv: volume average particle diameter;
*dn: number average particle diameter;

Preparation of series A of acceptor elements:

Each sample of reactive spacing particles according to table 1 was applied as an aqueous dispersion to a 100 μm thick subbed polyethylene terephtalate support at a coverage of 0.5 g/m². Then on top of each sample a silver behenate containing layer was separately coated out of methylethylketone containing following ingredients:

4.5 g/m² of silver behenate;

0.67 g/m² of commercial wetting agent DISPERSE AYD (Daniel Products Co, New Jersey) ;

0.9 g/m² of toning agent succinimide 3.3 g/m² of binder co(methylmethacrylate-butadiene);

0.08 g/m² of wetting agent $C_8H_{17}SO_3^-N^+(C_2H_5)_3$.

total coverage: 9.4 g/m².

Preparation of series B of acceptor elements

In this series of samples the spacing particles were not applied separately onto the support but were incorporated as aqueous dispersions in the silver behenate containing acceptor. So this series of acceptor layers contained:

4.5 g/m² of silver behenate;

1.1 g/m² of spacing agent (table 1)

0.67 g/m² of commercial wetting agent DISPERSE AYD (Daniel Products Co, New Jersey);

0.9 g/m² of toning agent succinimide 3.3 g/m² of binder co(methylmethacrylate-butadiene);

0.08 g/m² of wetting agent $C_8H_{17}SO_3^-N^+(C_2H_5)_3$.

total coverage: 10.5 g/m².

Preparation of the donor element

A donor element was prepared as follows, Onto a subbed 100 μm thick polyethylene terephthalate support a donor layer was coated out of methylethylketone containing following ingredients:

1.5 g/m² of reducing agent ethyl gallate;

0.5 g/m² of binder co(styrene-acrylonitrile);

0.16 g/m² of infra-red absorber IRD-1a;

0.24 g/m² of infra-red absorber IRD-1b;

total coverage: 2,4 g/m².

Exposure and further processing

Each different acceptor element and always an identical donor element were brought in close contact under vacuum. An electronically stored test pattern (full areas and lines) was exposed onto this sandwich through the donor backside by means of an external drum scanner equipped with a NdYLF laser emitting at 1053 nm, The scan speed was 8.8 m/s, The laser spot diameter (1/e²) was 14.9 μm and the energy range was from 0.65 to 1.0 W, After exposure the acceptor and donor were separated from each other and each acceptor was processed by pressing it with its backside against an aluminium block heated at 118 ° C.

Results

The evaluation of contact spots in exposed full areas was made using an arbitrary quality scale ranging from 1 (strong presence of contact spots) to 4 (no contact spots at all). The evaluation is summarized in table 2:

TABLE 2

| Sample No. spacing agent | Dn | contact spots for series A acceptors | contact spots for series Bacceptors |
|---|---|---|---|
| 1 (= none) | — | 1 | 1 |
| 2 | 3.34 | 2 | 2 |
| 3 | 4.42 | 3 | 3 |
| 4 | 6.83 | 4 | 3 |
| 5 | 12.4 | 4 | 3 |
| 6 | 3.63 | 2 | 2 |
| 7 | 4.47 | 3 | 3 |
| 8 | 7.54 | 4 | 4 |
| 9 | 12.1 | 4 | 4 |

The greater the reactive beads the more they will protrude outside the acceptor layer and the greater the improvement for the contact spot defect, as is illustrated by table 2.

The pinhole defect was overcome by the density built up in the spacing particle due to the reaction of the ethyl gallate reducing agent with the silver behenate. To illustrate this more clearly a further control acceptor layer containing non-reactive spacing particles was implicated in the evaluation. These spacing agent consisted of polystyrene beads with a number average diameter dn of about 15 μm. This acceptor element, a control element with no spacing agent and an acceptor similar to sample 9 (dn of 12.1 μm) were subjected to the same treatment cycles as described above. The laser energy on film was 0.82 W. The densities of the recorded full areas were measured by means of a Macbeth TD904 spectrophotometer using a UV or visual filter. The results are represented in table 3.

TABLE 3

| spacing agent in acceptor | Dmax (UV) | Dmax (VIS) | contact spots |
|---|---|---|---|
| — | 2.9 | 2.4 | 1 |
| polystyrene | 2.2 | 1.9 | 4 |
| sp. ag. with Agbeh. | 3.0 | 2.7 | 4 |

Compared to the control sample without spacing agent the density is lowered when a non-reactive spacing agent is present in the acceptor layer, This is due to the presence of pinhole defect, The density however is restored and the pinhole defect is avoided when using a reactive spacing agent, It was noted that when the spacing particles were too large (>12 μm) matte areas appeared in the single scan lines, It was further noted that the spacing particles did not interfere when the obtained image was used as a master for the exposure of a printing plate or of a proofing material as long as the particles were not too large, The optimum particle size was about 7.5 μm when the particles were present in the silver behenate layer and about 12.1 μm when the particles were incorporated under the silver behenate layer.

Example 2

This example was similar to the previous one with the exception that another reducing agent was used in the donor and that the reactive spacing agent was incorporated in a separate layer on top of the acceptor.

The composition of the donor layer was as follows:

2.6 g/m$^2$ of reducing agent dodecyl gallate 0.5 g/m$^2$ of binder copoly(styrene-acrylonitrile)

0.16 g/m$^2$ of IRD-1a 0.24 g of IRD-2a

This composition was coated out of methylethylketone at a total coverage: 3.5 g/m$^2$ The different acceptor elements were composed as follows (coated out of methylethylketone):

layer 1:

4.72 g/m$^2$ of silver behenate 4.72 g/m$^2$ of binder polyvinylbutyral (BUTVAR B79, Monsanto)

0.9 g/m$^2$ of toning agent succinimide 0.08 g/m$^2$ of BAYSILON A layer 2:

0.2 g/m$^2$ of polyvinylalcohol 1.0 g/m$^2$ of spacing agents Nos. 6 to 9 (see example 1) respectively as aqueous dispersions.

Exposure and further processing were like in the previous example.

The results of the evaluation of the contact spots are represented in table 4:

TABLE 4

| spacing agent sample No. | dn | contact spots |
|---|---|---|
| — | — | 1 |
| 6 | 3.6 | 2 |
| 7 | 4.5 | 4 |
| 8 | 7.5 | 4 |
| 9 | 12.1 | 4 |

No contact spots appeared anymore when reactive spacing agents larger than 4.5 μm were used. No pinhole defect was present.

Example 3

In this example a spacing agent containing carbon black was present on top of the donor element.

The preparation of this spacing agent was similar to the preparation of the reactive spacing agent of example 1. The composition was 95% ATLAC T500, 4% carbon black (Cabot Regal 400) and 1% of Eizencolor T-95 (Hodogaya) (negative charge controlling agent). The average particle size dn was 3.2 μm.

An acceptor layer was coated out of methylethylketone on a subbed 100 μm thick polyethylene terephthalate support. Its composition was:

4.42 g/m$^2$ of silver behenate;

4.42 g/m$^2$ of binder polyvinylbutyral (BUTVAR B79, marketed by Monsanto Co);

0.34 g/m$^2$ of toning agent 3,4-dihydro-2,4-dioxo-1,3,2H-benzoxazine;

17 mg/m$^2$ of silicone oil (BAYSILON A).

The donor element was prepared as follows. Onto a subbed 100 μm thick polyethylene terephthalate support were coated following layers:

first layer (donor layer) with following composition (coated out of methylethylketone):

1.0 g/m$^2$ of reducing agent ethyl gallate 0.2 g/m$^2$ poly(methylmethacrylate);

0.11 g/m$^2$ of infra-red absorber IRD-1a;

0.17 g/m$^2$ of infra-red absorber IRD-1b.

second layer (spacing agent layer). It was coated from following composition:

20 g of 1% aqueous solution of polyvinylalcohol;

0.2 g of the carbon containing spacing agent described above;

4 ml of commercial wetting agent GEBO.

The layer was coated at 7 μm wet thickness. The dried layer contained 0.1 g/m$^2$ of polyvinylalcohol and 0.1 g/m$^2$ of the spacing agent. The number of beads was about 400 per mm$^2$.

The exposure and further treatment was identical to the ones of example 1.

After transfer of the donor layer the density was 0.5 (UV) and after processing on a thermal block a density of 2.5 (UV) was obtained, when the laser energy on film was 0.92 W. Practically no contact spots appeared. Since the spacing agent itself contained carbon black and was transferred to the acceptor together with part of the donor layer no pinhole defect was visible.

Example 4

In this example reactive spacing particles containing a reducing agent were present on top of the donor element.

The reactive spacing agent was prepared in a way similar to the one described in example 1. The composition was 80% of resin ATLAC T500, 9.5% of $Al_2O_3$-C (Degussa, Germany), 10% of reducing agent ethyl gallate and 0.5% of silica (Aerosil R812S, Degussa). The average particle diameter was about 6 μm.

The acceptor element and the first layer (donor layer) of the donor element were the same as in previous example 2. The second layer (spacing agent layer) was coated from following aqueous coating composition:

20 g of a 1% aqueous solution of polyvinylalcohol;

0.2 g of the reactive spacing agent containing ethyl gallate described above;

2 ml of commercial wetting agent GEBO,

The layer was coated at 7 μm wet thickness. The dried layer contained 0.1 g/m$^2$ of polyvinylalcohol and 0.1 g/m$^2$ of the spacing agent. The number of beads was ,about 250 per mm$^2$.

The exposure and further treatment was identical to the ones of the previous examples.

A density of 2.0 (UV) was obtained when the laser energy on film was 0.92 W. Practically no contact spots appeared. Since the reactive spacing agent was transferred together with part of the donor layer reaction could take place between the ethyl gallate in the spacing agent and the silver behenate in the acceptor layer so that additional density was built up. Therefore the transferred spacing agent introduced no pinhole defect in the acceptor.

Example 5

In this example the donor element contained a reactive spacing agent containing silver behenate.

The reactive spacing agent was prepared in a way similar to the one described in example 1. The composition was 89% of resin ATLAC T500 and 11% of silver behenate. The average particle diameter dn was about 3 μm.

The acceptor element and the first layer (donor layer) of the donor element were the same as in previous example 2. The second layer (spacing agent layer) was coated from following coating composition:

20 g of a 1% aqueous solution of polyvinylalcohol;

0.2 g of the silver behenate containing reactive spacing agent described above;

2 ml of commercial wetting agent GEBO.

The layer was coated at 7 μm wet thickness. The dried layer contained 0.1 g/m$^2$ of polyvinylalcohol and 0.1 g/m$^2$ of the spacing agent. The number of beads was about 400 per mm$^2$.

The exposure and further treatment was identical to the ones of the previous examples.

A density of 3.2 (UV) was obtained when the laser energy on film was 0.92 W. Practically no contact spots appeared. Since the reactive spacing agent was transferred together with part of the donor layer reaction could take place in the acceptor between the transferred ethyl gallate of the donor layer and the silver behenate in the transferred spacing agent. In this way the appearance of pinholes was avoided.

Example 6

This example illustrates the use of a leucobase-acid reactive pair of ingredients present in the donor and acceptor element respectively.

A donor element according to following composition was prepared. Onto a subbed polyethylene terephthalate support of 100 μm thickness a donor layer was coated from a methylethylketone solution containing following ingredients:

0.5 g/m$^2$ of binder BUTVAR B79;

0.4 g/m$^2$ of ⅔ mixture of infra-red absorbers IRD-1a/IRD-1b;

2 g/m$^2$ of leucodye PERGASCRIPT SCHWARZ 3R (Ciba-Geygy) represented by following formula:

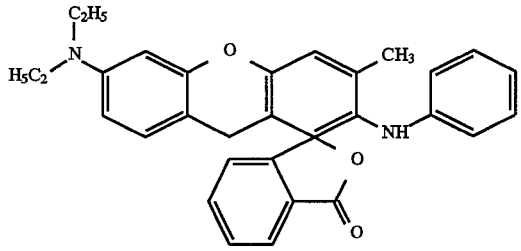

An acceptor layer was coated from a methylethylketone solution on a similar support according to following composition:

0.5 g/m$^2$ of a copoly(styrene-acetonitrile) binder;

1.5 g/m$^2$ of an acid being benzyl-p.-hydroxybenzoate corresponding to following formula:

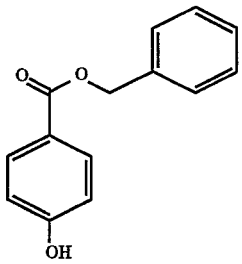

In a control experiment wherein none of both layers contained spacing particles the donor-acceptor pack was exposed through the back of the donor by means of a NdYLF laser at 400 rpm (4.4 m/s), 3384 dpi, a spot diameter (1/e$^2$) of 14.9 μm, and a power of 380 mW. The leucodye was transferred from the donor to the acceptor where it reacted immediately with the acid without the need of a heat post-treatment. After removal of the donor layer a density of 1.2–1.5 (UV) was measured in the exposed areas of the acceptor element. However contact spots were apparent. In an experiment according to the invention the acceptor layer was coated with an extra layer comprising a polyvinylalcohol binder (0.1 g/m$^2$) and spacing particles (dn=6.2 μm) composed for 90% of ATLAC T500 polyester resin and for 10% of acid benzyl-p.-hydroxybenzoate (0.5 g/m$^2$). Contact spots were no longer present and the obtained density was sufficiently high.

We claim:

1. Method for the formation of a heat mode image comprising the steps of (1) exposing to an information-wise distributed heat pattern a donor element comprising a support and at least one layer comprising a reactant (A) while in contact with an acceptor element comprising a support and at least one layer comprising a reactant (B), the said reactant (A) being transferred by said exposure from said donor element to said acceptor element to form an image therein by reaction of said reactant (A) with said reactant (B), (2) separating said donor and said acceptor element from each other, and (3) optionally giving said acceptor element a post-treatment consisting of a supply of extra energy, characterized in that the said acceptor element comprises spacing particles also containing a said reactant (B), and/or the said donor element comprises spacing particles also containing a said reactant (A), or a said reactant (B), or a density providing compound, or combinations thereof.

2. Method according to claim 1 wherein said information-wise distributed heat pattern is generated by a thermal printing head.

3. Method according to claim 1 wherein said information-wise distributed heat pattern is generated by information-wise exposure to laser radiation and the presence in said donor element of a substance capable of converting laser radiation into heat.

4. Method according to claim 3 wherein said laser radiation is generated by an infra-red laser and said substance is an infrared absorbing compound.

5. Method according to claim 1 wherein said reactant (A) present in said donor element is a reducing agent, and said reactant (B) present in said acceptor element is a reducible organic silver salt, and wherein said post-treatment (3) is a uniform heat post-treatment of the separated acceptor element.

6. Method according to claim 5 wherein said donor element comprises spacing particles containing a said density providing compound.

7. Method according to claim 5 wherein said donor element comprises spacing particles containing a said reducing agent.

8. Method according to claim 5 wherein said donor element comprises spacing particles containing a said reducible organic silver salt.

9. Method according to claim 5 wherein said acceptor element comprises spacing particles containing a said reducible organic silver salt.

10. Method according to claim 5 wherein said reducible organic silver salt is silver behenate.

11. Method according to claim 1 wherein said density providing compound is carbon black.

12. Method according to claim 5 wherein said reducing agent is ethyl gallate or dodecyl gallate.

13. Method according to claim 1 wherein said reactant (A) present in said donor element is a leucodye and said reactant (B) present in said acceptor element is an acid capable of reacting with said leucodye thus forming a dye.

14. Method according to claim 13 wherein said acceptor element comprises spacing particles containing a said acid capable of reacting with said leucodye thus forming a dye.

* * * * *